US008468931B2

(12) United States Patent
Johnson

(10) Patent No.: US 8,468,931 B2
(45) Date of Patent: Jun. 25, 2013

(54) ELECTRO-MECHANICAL CONTROL SYSTEM FOR POSITIONING FLUID MOTORS

(76) Inventor: James B. Johnson, Boca Raton, FL (US)

( * ) Notice: Subject to any disclaimer, the term of this patent is extended or adjusted under 35 U.S.C. 154(b) by 638 days.

(21) Appl. No.: 12/725,802

(22) Filed: Mar. 17, 2010

(65) Prior Publication Data

US 2011/0226125 A1 Sep. 22, 2011

(51) Int. Cl.
*F15B 9/10* (2006.01)
*F01B 19/04* (2006.01)

(52) U.S. Cl.
USPC ..... 91/383; 92/93

(58) Field of Classification Search
USPC ..... 91/368, 383; 92/89, 93, 105
See application file for complete search history.

(56) References Cited

U.S. PATENT DOCUMENTS 2,572,902 A 10/1951 Ashton
2,602,298 A 7/1952 Ashton et al.
2,761,285 A 9/1956 Beecroft
3,106,872 A 10/1963 Hegg et al.
3,143,924 A 8/1964 Pearson et al.
3,929,032 A 12/1975 Kehm
3,997,062 A 12/1976 Hassall
4,190,080 A 2/1980 Le Devehat
4,225,110 A 9/1980 Akkerman et al.
4,354,595 A 10/1982 Reynolds
4,526,204 A 7/1985 Primdahl
4,710,141 A 12/1987 Ferguson
4,930,336 A * 6/1990 Smedberg et al. ..... 72/453.13

FOREIGN PATENT DOCUMENTS

EP 0143740 5/1985
GB 718107 11/1954

* cited by examiner

*Primary Examiner* — Michael Leslie
(74) *Attorney, Agent, or Firm* — McHale & Slavin, P.A.

(57) ABSTRACT

A fluid motor and a control system that includes an electronic controller and a mechanical servo to position a fluid motor. The electronic controller is combined with a non-electronic self storing position feedback device. The electronic controller is capable of providing accurate positioning and the positioning is maintained with a mechanical servo mechanism. The fluid motor can be either hydraulically or pneumatically operated.

13 Claims, 4 Drawing Sheets

ELECTRO-MECHANICAL CONTROL SYSTEM FOR POSITIONING FLUID MOTORS

FIELD OF THE INVENTION

The present invention relates to a fluid power drive control system and more particularly to a control system that combines an electronic command source with a non-electric self storing position feedback device to provide accurate positioning of the fluid driven member.

BACKGROUND OF THE INVENTION

Fluid power positioning systems that utilize an electronic command control and an electronic feedback system are well known and have been the object of continuing development. These relatively sophisticated systems use an electronic control circuit to compare a fluid motor's intended position to its actual position. The control circuitry compares the difference, or error, between command and feedback signals and then provides an electronic output, via an amplifier, to a servo or fluid proportioning valve to reposition the fluid motor. Such systems are generally expensive to design, manufacture and operate. Conventional position feedback methodologies for these systems include linear variable displacement transducers (LVDTs), resistive strips, magnetostrictive devices, ultrasonic position sensors, wire-rope potentiometers, laser distance measuring and encoders. Electronic servo controllers, valves and feedback devices are generally highly accurate and responsive. Their high performance and concomitant high cost renders them a first choice only when technologies using less complex or less expensive methods will not work. Electricity must be continually supplied to the valve, feedback device and controller for each to remain active. In other words, if the feedback device were to lose electric power, the entire system would no longer be able to make corrections for errors in position. When installed in hostile environments, premature failure of electronic components can occur. Hostile environments include exposure to temperature extremes, sunlight, corrosive fluids including water, dust, and other elements. In hostile environments, wires, controllers and sensitive electronics must be encapsulated to increase their life, adding to their cost.

DESCRIPTION OF THE PRIOR ART

U.S. Pat. No. 2,602,298, to Ashton et al, is directed to a system for controlling the movement of a plurality of hydraulically actuated motors to equalize their movements. More particularly, the invention relates to control valve systems for regulating the supply of fluid delivered to a plurality of hydraulic motors, such as for example hydraulic rams or jacks to cause equal movement of the jacks. The system includes at least two equalizing valves of a type having valve elements displaceable against a biasing force by the pressure of the fluid supplied to at least two hydraulic motors, the motors being in turn connected to and controlling the biasing force exerted on the moveable valve elements. The relation of the biasing force and the movement of the motors is such that any tendency of one of the motors to move faster than the other motor will increase the biasing force opposing the flow of liquid to the faster moving motor and thereby reduce the pressure and volume of the liquid actuating the faster moving motor to reduce its speed.

U.S. Pat. No. 2,761,285, to Beecroft, is directed to a power operated member or device whose movement is to be correlated to the movement of another member or device is operated by a control, and this control in turn is actuated by a controlling device having a neutral position allowing the control to remain in its initial position. The controlling device in turn is operated by a device or system having in effect an extensible and retractable action and extending between the controlling device and moving members which are correlated. When the movement of the latter varies from desired correlation, the controlling device is moved by such extensible and retractable device or system from its neutral position in a manner to restore the moving members to desired correlated positions. More particularly the invention includes a drum having a neutral position which orients the control or the control valve in an initial or preset position. Cables are wound over the drum from opposite directions, and the length of the cables are regulated whereby with the moving members in correlated position the tension in the cables under winding tension of the drum. The drum in the neutral position will be exactly balanced to provide an equal and opposite pull on the drum, thereby balancing the drum in its neutral position. When the cables are wound on or off the drum at different rates caused by the members moving out of correlated position the cable tensions tend to vary and the drum accommodates the tendency by displacing from its neutral position in a direction to operate the control or valve to again restore the members to correlated positions. In one embodiment the control member is in the form of an indicator arm having an associated dial.

U.S. Pat. No. 3,106,872, to Hegg et al, is directed to a power control mechanism wherein pluralities of positioning mechanisms are coordinated to move in equal increments. It includes a control or "follow up" system in which operation of a servo mechanism is communicated to the control mechanism therefore and mechanically compared with the operation of another servomechanism to effectuate equal servo mechanism operation.

U.S. Pat. No. 3,143,924, to Pearson et al, is directed to an apparatus having a plurality of hydraulic cylinder drive assemblies that includes a control system for accurately synchronizing the piston movements of two or more hydraulic cylinder drive assemblies that are connected in series.

U.S. Pat. No. 3,997,062, to Hassall, is directed to a synchronizer apparatus for multi section telescopic jibs comprising travel sensors each to be carried by a moveable jib section in at least one group of at least three sections. One of the sensors being adapted for interconnection with two travel sensors carried one by each of the two other sections in the group for sensing disproportionate travel of one moveable section relative to travel of a further section with respect to another section. A signal device actuable by the sensors of each group and operative means for connecting the signal device to a power transmission valve associated with rams respectively operatively connected to the said one and said further moveable sections for controlling the travel of at least one of them to remove any disproportionate travel.

U.S. Pat. No. 4,190,080, to Le Devehat, is directed to an articulated fluid loading arm for delivery of gasoline or other liquids through a drop pipe into a tank truck or railway tank car. The arm is equipped with a control system comprising a hydraulic jack for regulating the angle defined by the inboard and outboard arm sections. A sensor system senses a change in the attitude of these two arm sections and actuates the hydraulic jack to maintain the drop pipe in an established azimuthal position as it is lowered into and raised out of the tank truck or tank car hatch. The apparatus includes means for adjusting the sensor system to make it functional for various locations of the pipe drop.

U.S. Pat. No. 4,354,595, is directed to a method and apparatus for maintaining relative positional alignment between two spaced-apart points on a moveable member, such as a rotating axle on which is mounted a conveyor belt pulley. The apparatus includes a hydraulic pump which is operatively communicated to first and second hydraulic cylinders. The first hydraulic cylinder applies a reference pressure to a first point on the axle and moves the axle to maintain the pressure at a constant predetermined pressure level. The second hydraulic cylinder is operatively connected to a second point on the axle spaced apart from the first point. A fork and pin mechanism sense relative movement between the first point and the second joint on the axle. A hydraulic servo-valve directs hydraulic fluid to the second hydraulic cylinder for moving the axle at its second point in a direction and for a distance corresponding to the movement of the axle at the first point.

SUMMARY OF THE INVENTION

The invention is directed to a control system for a fluid motor that includes an electronically controlled positioning (stepper) motor, a self-storing mechanical feedback/valve actuator assembly and a mechanically controlled valve. It can be used to position a fluid motor that is either hydraulically or pneumatically powered. The feedback/valve actuator section is capable of providing accurate positioning of a fluid motor. A characteristic of the invention is that when the stepper-driven "command" spool is prevented from rotating by a spring-applied brake, the feedback/valve actuator device remains active after electric power is turned off. This is true as long as fluid pressure and flow capacity are supplied to the inlet of the valve. This attribute enables the invention to hold a pneumatic fluid motor in position indefinitely; while making position corrections to compensate for changes in air compression should any changes in the load pressure occur. Another characteristic is the low cost and simplicity of the components of which the device is comprised. Stepper motors and their controllers are widely used internationally and as such, have a low price point. Command, feedback, position-error summing and power amplification are performed by an exceedingly simple mechanical device within the invention. Another characteristic is the hardy resistance of the mechanical feedback line to detriment by hostile environments. Another characteristic is the flexibility of the feedback line, which enables it to be attached to loads that travel a curved path. Still another characteristic is that several fluid motors, each outfitted with the invention, can be positioned in exact synchronization, or in ratio synchronization, to each other and other devices by means of a master electronic controller. A simple housing contains the stepper motor, take up spool, holding brake and fluid motor control valve for ease of installation and use. The electronic command source is a stepper motor controller, which provides position and speed control to the stepper motor. This controller may be remotely located or built within the motor. It communicates with and sends position commands to the stepper either by wires or wirelessly. Stepper motors may be run in open or closed loop control architectures. Rather than its common use as an output device to perform work, the stepper motor in this invention is a signal converter. It transforms an electronic position command into a mechanical servo input signal. This signal is the command input for the servo. The stepper motor is operatively connected to a take up spool for positioning a command tension line wound there upon.

Command and feedback tension lines can take various forms, such as metal cable, string, rope, synthetic or fabric tape, wire and so on. Lines may be flat or round or have any cross sectional shape. Flat lines are preferred, as this form does not require a level-wind device for spool storage. The command line connects the take-up spool to a spring-biased spool, around which it is wrapped. The command line and a feedback line are wound on top of each other over the spring-biased spool. Command and feedback lines approach the spring-biased spool from opposing sides. The feedback tension line can be attached directly to the fluid motor or to any member moved by it.

A torsion spring biases the spool to rotate so as to wind both lines onto its surface. The spring-biased spool is moveable and in operative relationship with a valve actuator. The valve actuator will operate to control a fluid control valve to position the fluid motor. At rest, with the stepper motor at standstill, the spring-biased spool exerts a force that is equally shared by the command and tension lines. In this state, the fluid valve is in a null position. In the null position, the valve directs exactly the volume of fluid to create the required pressure to hold the fluid motor in a stationary position. When a rotational change is made to the stepper's shaft, the balance of forces between the command and tension lines changes. This imbalance causes a reaction force, which moves the spring-biased spool about its axis, shifting the valve. The fluid motor moves, its rate in proportion to the amount the valve is shifted. Velocity control of the fluid motor is possible within the control system's dynamic capability. When the stepper's shaft is stopped, the spring-biased spool also stops. This causes the spring-biased spool tension to again be equally shared between the command and feedback lines and the valve actuator returns to its null position, stopping the fluid motor. An electrical switch on either side of the self-storing mechanical servo assembly is activated if a) either tension line fouls or breaks, or b) if the fluid motor runs ahead of or lags behind the stepper motor by an excessive amount. The electrical switch provides an input signal to the stepper controller. The stepper motor need only be of sufficient size to develop the torque necessary to overcome the biasing spring and accelerate/decelerate the spring-biased spool. In its role as a signal converter, a small stepper motor can be used to position a fluid motor of any bore size and displacement, accurately positioning loads into the tons.

A counterweight and cable can be used in place of a torsion spring in the spring-loaded drum. In addition, gearing can be used between the torsion spring and the summing spool. Only a partial revolution of the spring-biased spool is necessary for fluid motors traveling only a short distance. This allows a torque arm and linear spring to be used in place of a torsion spring. The valve actuator can be adapted to work both linearly and rotationally shifted fluid control valves. The valve should be of a type with as little overlap in the neutral "off" position as possible, or a slight underlap. The fluid motor may be a rod, rod-less or a rotary type. Spring-retracted idler rollers may be added to keep tension on the command and feedback lines in long travel applications. These also dampen the servo loop. Less complexity and cost is involved than with conventional electronic feedback/servo methodologies for fluid power actuators.

The fluid motor control system can be used to properly position and maintain the height of a pneumatic lift table. It can also be employed in systems that provide automatic and remote height adjustment of vehicle suspensions, rail cars, and platforms consisting of multiple sections. It can be used with press devices, to advance the fluid motor in a controlled and unloaded manner to a point near the object to be pressed prior to the press operation. Another application is in the automated detection of solid objects. For example, if the stepper continues to command the fluid motor forward after the fluid motor has stalled against an immovable object, the electrical switch activates. This can prevent damage to personnel and machinery by first cycling a fluid motor at low pressure, to detect objects in the way, prior to running cycles at full pressure. Object detection is also useful in determining a beginning point from which to operate several fluid motors in synchronization. An example is in the automated and level lifting of large, irregularly shaped objects. Several fluid motors attached to a point beneath an object to be lifted can be independently or collectively extended at low pressure, each stalling upon its point of contact with the object. A master controller is notified of each fluid motor's stalled condition by actuation the electrical switch in each fluid motor drive. After all the fluid motors have stopped, the pressure can be increased and same master controller can send a simultaneous move signal to all of the fluid motor drives. All of the fluid motors move together, keeping the object in the desired orientation while the object is lifted.

Accordingly, it is an objective of the instant invention to provide a fluid motor control system that includes a very precisely controlled stepper motor actuator.

It is a further objective of the instant invention to provide a low cost closed loop feedback control system for a fluid motor.

It is yet another objective of the instant invention to provide a closed loop feedback control system that is simple and rugged in design and is capable of normal and long term operation even in hostile working environments.

It is a still further objective of the invention to provide a safe and reliable fluid power positioning system with feedback control that is relatively low in initial, operational and maintenance costs.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 3:
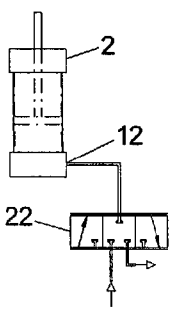
FIG. 3 is a schematic diagram of the pneumatic control system in FIG. 1.
Figure 1:
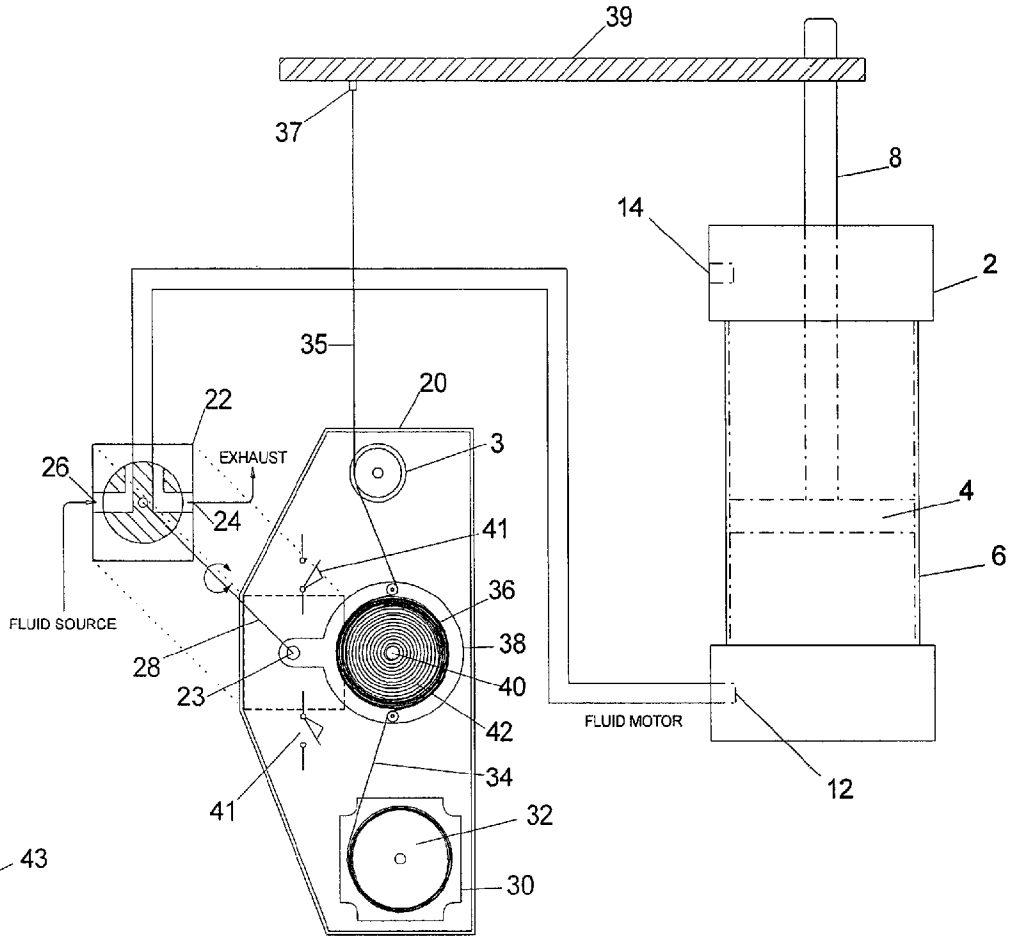
FIG. 1 is a diagram of the control system utilizing a single-acting pneumatic cylinder.
Figure 2:
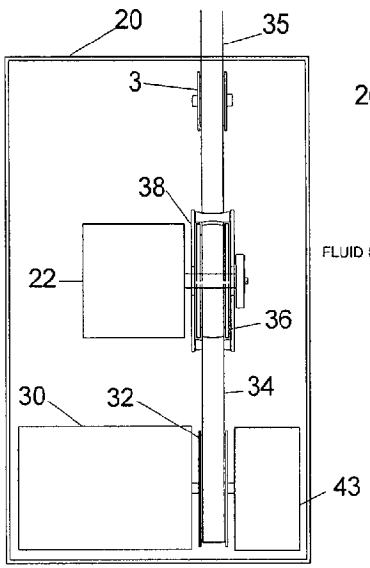
FIG. 2 is a top view of the control system in FIG. 1.
Figure 5:
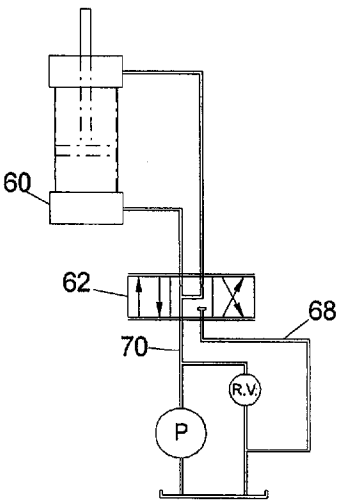
FIG. 5 is a schematic diagram of the hydraulic control system in FIG. 4.

FIG. 1 is a schematic representation of the fluid motor and control system including a feedback control device that will provide accurate positioning of the fluid motor. The invention as shown in FIG. 1 includes a single acting fluid motor 2 having a piston 4 located within a working cylinder 6. Affixed to the piston 4 is an actuator rod 8. A rotary motor with a rotary actuator could be used in lieu of the piston and cylinder arrangement and linear actuator as shown. The fluid motor 2 includes inlet/outlet fluid passageways 12 and 14 located at opposite ends of the working cylinder 6. The fluid motor control system includes a housing 20. A fluid control valve 22 and a pair of fluid ports 24 and 26 are contained within housing 20. A valve actuator 28 is pivotally connected 23 in operative relationship with valve 22 to control the ingress and egress of fluid from ports 24 and 26. Control valve 22 is a multi way valve that is construed to include linear or rotary valves and is not intended to be limited to pneumatic and hydraulic valves where the movements of the internal parts are rotary only.

Limit switches 41 are positioned for actuation by the tension-summing actuator 38 if the command and feedback lines' tension differential is high enough. FIG. 1 also shows the stepper motor 30. Attached to the rotary output shaft of stepper motor 30 is a take-up spool 32. The stepper motor establishes the input position command. A command tension line 34 is attached to and wound about take-up spool 32. A spring-applied, electrically released holding brake 43 is also attached to take-up spool 32. The brake is released during stepper motor operation and set when the stepper is idle. The command tension line 34 leaves take-up spool 32 and is then wound about spring-biased spool 36 on the tension-summing actuator 38. The spring-biased spool 36 is rotatably mounted on a fixed shaft 40 through a torsion spring 42. The tension summing actuator 38 and spool 36 are mounted for bodily movement as well as rotary movement. The spool 36 can be acted upon by either a spring or counterweight to wind in the command and feedback lines. Bodily movement of the tension summing actuator is to be construed to include linear or angular movement and not limited to angular movement only. The fixed shaft 40 is mounted in a fixed position relative to valve actuator 28. Valve actuator 28 acts to regulate the pressurized fluid (pressurized by a pump) via action of the valve 22 directed to the lower side of piston 4 located in fluid cylinder 6. The feedback tension line 35 leaving the spring-biased spool 36 passes across a roller 3 and is then attached to an object to be positioned by the actuator rod 8 of fluid motor 2. As illustrated the feedback tension line 35 is attached by a fastener 37 affixed to a platform 39. The feedback tension line 35 between the platform 39 and the tension-summing actuator 38 provides the control system with the feedback signal. Platform 39 in turn is secured to the actuating rod 8.

The initial position of platform 39 is controlled by the operation of electronically controlled stepper motor 30. The stepper motor is programmable and, upon release of holding brake 43, can precisely pay out or take up a predetermined quantity of command line 34. The resulting inequality in tension between the command line 34 and the feedback line 35 creates a reaction force, which moves the tension-summing actuator 38 and valve actuator 28 about its axis. This movement shifts valve 22, resulting in a positional change to actuator 8 and therefore platform 39. The programmable stepper motor 30 is also capable of producing a variable velocity profile wherein the rate of rotational velocity can be increased or decreased at various rates of acceleration or deceleration or held constant. As the command tension line 34 is wound or unwound on spool 32 the valve actuator 28 is pivoted in such a manner as to control the inflow and outflow from ports 24 and 26. The pressurized fluid, such as pneumatic or hydraulic fluid, is thereby introduced or exhausted from port 12. When the stepper shaft is stopped, command tension line 34 and feedback tension line 35 equally share the bias spring 42 induced torque. This action creates a centering force which centers the tension-summing valve actuator 38, and nulls the valve, holding the fluid motor in a fixed position. Thereafter, should a force be directed upon the platform 39 or removed from the platform 39, such as the addition of weight to or from the platform, causing the platform to move from its commanded position, the tension summing actuator 38 will pivot thereby keeping the commanded position.

Figure 4:
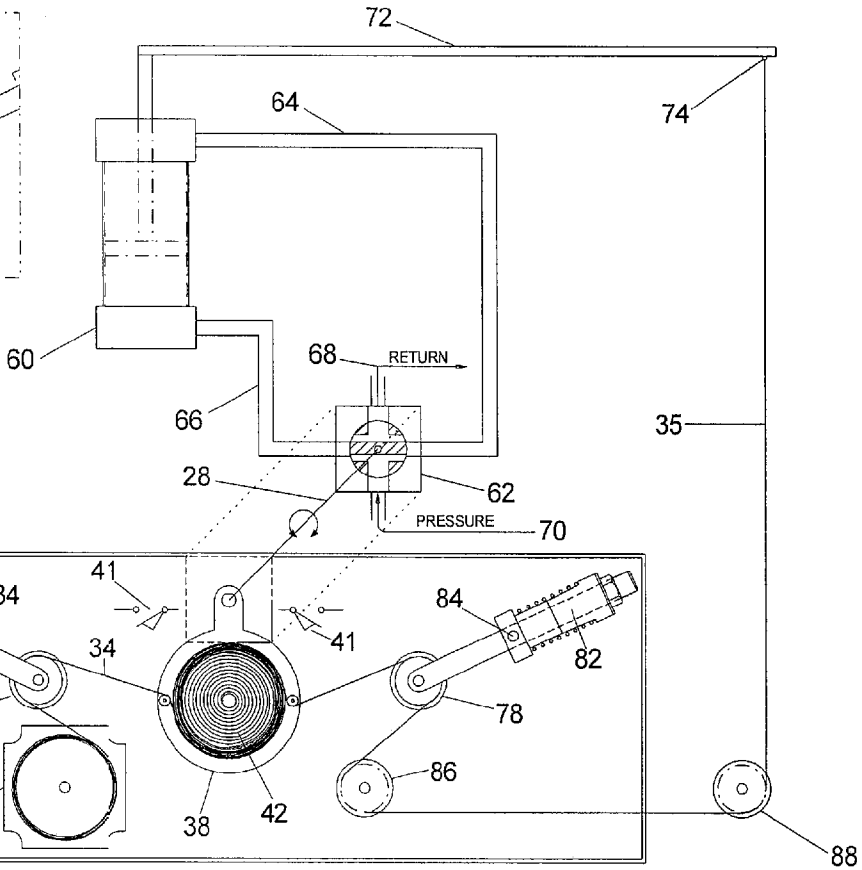
FIG. 4 is a diagram of the control system utilizing a double-acting hydraulic cylinder.

The embodiment shown in FIG. 4 is similar to that of FIG. 1. In this embodiment the fluid motor is a double acting fluid motor 60. Double acting fluid motor 60 is controlled by a 4-way valve 62 which is fed by a supply line 70 and an exhaust line 68. The fluid enters and exits double acting cylinder 60 via lines 64 and 66 as controlled by 4-way valve 62. The feedback tension line 35 between the tension summing valve actuator 38 and the platform 72 is attached to platform 72 by a suitable fastener 74. Spring retracting roller supports 80 and 82 are pivotally mounted 84 and exert a fraction of the spring force exerted by the tension summing actuator 38 on the tension lines. Rollers 76 and 78 are held in their fully extended position when the tension-summing valve actuator 38 is centered and the stepper motor shaft is stopped. Roller 78 partially retracts when the stepper motor winds command line 34 onto the take-up spool 32. Similarly, roller 76 partially retracts when the stepper pays command line 34 off of the take-up spool 32. Roller 76 and 78 keep tension on the command and feedback lines during rapid or long moves. Feedback line 35 passes over idler rollers 86 and 88. The tension-summing actuator 38 and stepper motor 30 function in the same manner as described with respect to FIG. 1.

Figure 6:
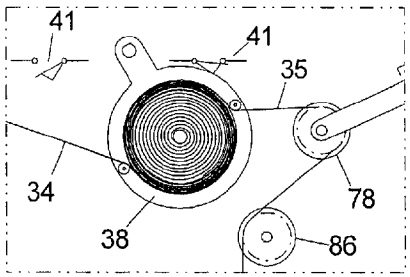
FIG. 6 is a diagram of the electrical switch in its activated state.

FIG. 6 illustrates the actuation of switch 41, in the event of a line break, excessive positional error, or when the fluid motor is used for solid object detection as described above. In the illustration, the stepper motor delivers command line 34 to the tension summing actuator 38 at a faster rate than the feedback line 35 is delivered by movement of the fluid motor 60. During normal operation, the tension summing actuator deviates very little from its null position. Valve 62 and the fluid motor 60 are sized to keep the deviation small. If the fluid motor cannot keep up with or runs ahead of the rate dictated by the stepper, the tension summing actuator 38 deviates an excessive amount, activating either of the two limit switches 41, depending on the direction of the error. The output signal from the switch 41 can be used to shut off the device for safety purposes. In addition to their safety utility, the switches may be intentionally used as a control input for solid object detection.

Figures 7A, 7B, 7C, 7D:
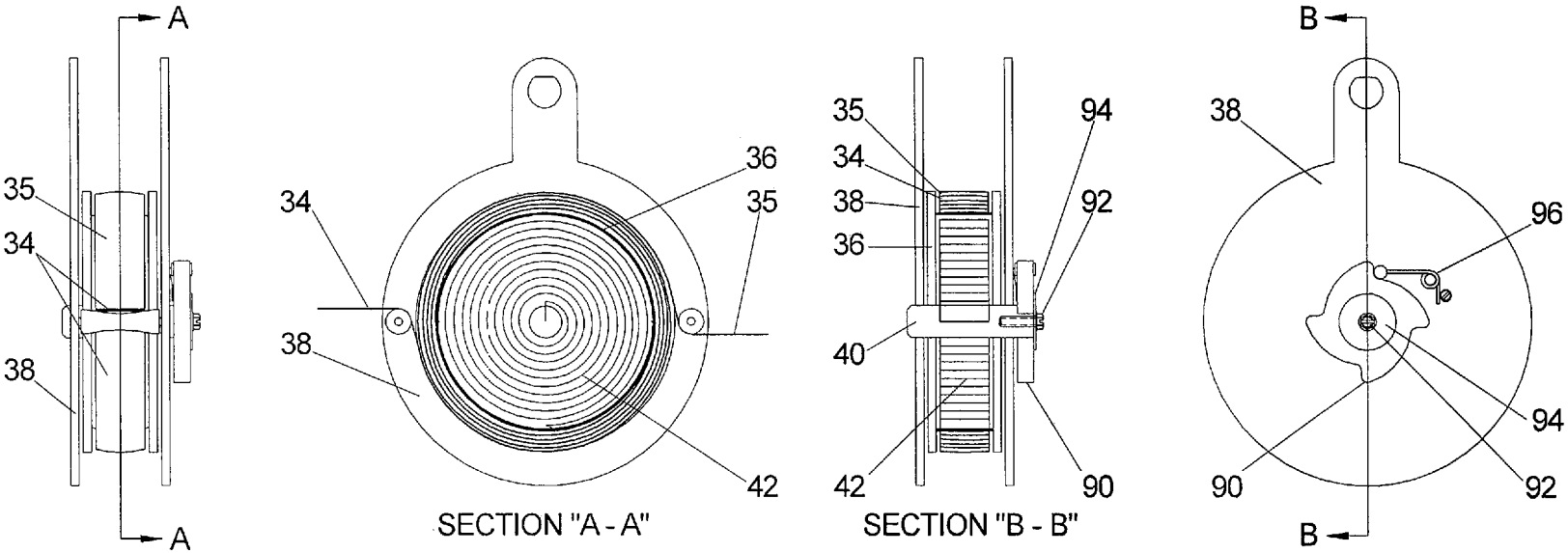
FIGS. 7A through 7D are views of the tension summing valve actuator, including the spring-biased spool, tape-over-tape, valve actuator and wind-up mechanisms.

FIGS. 7A through 7D are various views of the tension-summing valve actuator 38. FIG. 7A is an end view of the tension summing actuator 38 wherein the command line 34 and the feedback line 35 are formed as a flat tape rather than as a cable, line or rope. FIG. 7B is a side sectional view of the tension summing actuator 38 wherein the command line 34 and the feedback line 35 are wound on top of each other over a spool 36. The spool is biased by a torsion spring 42 to create winding tension. FIG. 7C is an end sectional view of the tension summing actuator 38 illustrating the relative positions of the command and feedback lines 34 and 35, torsion spring 42 and the shaft 40 about which spool 36 rotates. A ratchet mechanism 90 is fixed to the shaft 40 by means of a fastener 92 and a washer 94. FIG. 7D is a side view of the tension summing actuator 38 illustrating the relative positions of ratchet mechanism 90, which when rotated counter clockwise, causes spring 42 to wind up upon shaft 40. Spring mechanism 96 prevents ratchet 90 from moving clockwise. Fastener 92 and washer 94 retain ratchet mechanism 90.

Figure 8:
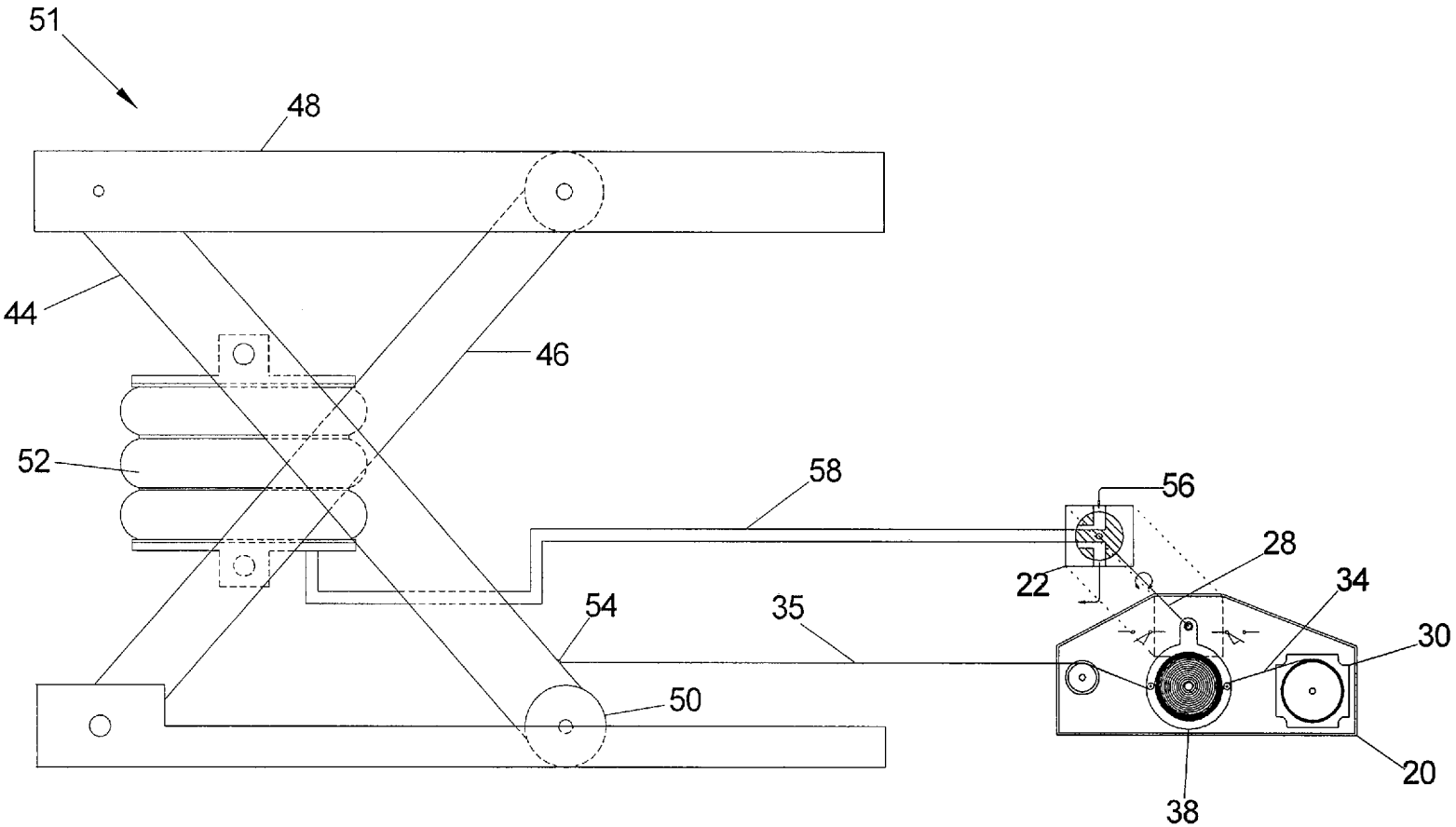
FIG. 8 is a diagram of the control system utilizing a single-acting actuator with a scissors type lift platform.

FIG. 8 illustrates the fluid motor control system used in combination with a pneumatic lift table 51. The lift table is shown as being illustrative of the environment in which the fluid motor control system can be used. The system has application to other and widely diversified situations and equipment, such as automatic and remote height adjustments of vehicle suspensions, rail cars, and level platforms on uneven terrain. In this embodiment, the ability to hold position despite varying loads is especially useful. Lift table 51 includes two pairs of pivotally connected legs 44 and 46 and a fluid motor actuator, in this example pneumatic, positioned between legs 44 and 46. The top ends of legs 44 and 46 are pivotally connected to a platform 48 while the bottom ends of legs 46 are pivotally attached to a base and the bottom ends of legs 44 are mounted on rotatable wheels 50. In this configuration the fluid motor is a bellows type, or air spring type, expansible chamber device formed from elastomeric material. As the motor 52 expands in a vertical direction under the influence of increasing pressure, the scissors action of legs 44 and 46 will likewise move the platform 48 in the vertical direction. At the same time the bottom of legs 44 and wheels 50 will move in the horizontal direction. A feedback control line 35 is attached to the bottom of one of legs 44 with a suitable fastener element 54. A source of pressurized air is controlled by the action of valve 22 that regulates the supply of air to fluid motor 52 via line 58. As in FIG. 1, the fluid motor and control system also includes a housing 20. Housing 20 includes stepper motor 30 which provides the desired input command to the tension-summing actuator 38. The valve actuator 28 of tension-summing actuator 38 is pivotally attached to valve 22 to regulate the flow of working fluid. Once the platform 48 height is set by stepper motor 30, any changes in force acting upon the platform 48 that result in a change in the height of the platform will result in the movement of feedback line 35 located between attachment 54 and tension-summing actuator 38. The tension-summing actuator 38 will then impart a rotary movement to valve 22 via valve actuator 28 in the manner described in FIG. 1. The adjustment to valve 22 causes a change in fluid pressure in fluid motor 52 sufficient to reestablish the original preset position of platform 48.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A fluid motor control system comprising:

a fluid motor including a mechanical actuator, said fluid motor having an input and output source;

a source of pressurized fluid to provide a working fluid to said input of said fluid motor;

a multiway control valve to control the flow of said pressurized fluid to said input of said fluid motor, wherein said multiway way valve is operatively connected to a tension summing actuator using a valve actuator;

said tension summing actuator is operatively connected to said stepper motor by a tension command line and thereby provides a command position for said fluid motor, said stepper motor operatively rotates a spool connected to said tension command line;

said tension command line is an elongated tape member;

said tension summing actuator being further operatively connected and indirectly cooperates with said output of said fluid motor by a tension feedback line and thereby provides a feedback command to said tension summing actuator; and limit switches in operative relationship with said tension command line and said tension feedback line that generate an electrical signal when either an excessive positional error or object detection occurs.

2. The fluid motor control system of claim 1 wherein said stepper motor is programmable, whereby a variable motion profile can be programmed so as to vary the rate of change of said actuator.

3. The fluid motor control system of claim 2, wherein said tension summing actuator includes a tension summing actuator spool, said tension summing actuator spool is rotatably mounted and resiliently fixed using a biasing element on a fixed shaft, wherein said tension command line and said tension feedback line are wrapped one over the other on said tension summing actuator spool.

4. The fluid motor control system of claim 3 wherein said tension summing actuator, said stepper motor and said multi way valve are mounted on a common housing.

5. The fluid motor control system of claim 4 wherein said fluid motor is a single acting actuator.

6. The fluid motor control system of claim 4 wherein said fluid motor is powered by a source of pressurized air.

7. The fluid motor control system of claim 4 wherein said output of said fluid motor is operatively connected to a pair of legs that support a vertically adjustable platform.

8. The fluid motor control system of claim 7 wherein said tension feedback line is indirectly attached to said fluid motor actuator at the bottom of one of said pair of legs.

9. The fluid motor control system of claim 6 wherein said fluid motor is an expansible chamber device having resiliently deformable walls.

10. The fluid motor control system of claim 4 wherein said fluid motor is a double acting actuator.

11. The fluid motor control system of claim 10 wherein said multiway control valve is a four way valve.

12. The fluid motor control system of claim 9 wherein the fluid motor includes a piston within a working cylinder.

13. The fluid motor control system of claim 1 further including a spring-applied electrically released holding brake in operative relationship to said tension command line whereby said brake is released during powering of said stepper motor and set when the power is turned off.

* * * * *